US010273988B2

(12) United States Patent
Kondo et al.

(10) Patent No.: US 10,273,988 B2
(45) Date of Patent: Apr. 30, 2019

(54) FLUID PRESSURE SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Makoto Ito, Kobe (JP); Kazuto Fujiyama, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 245 days.

(21) Appl. No.: 15/111,940

(22) PCT Filed: Dec. 24, 2014

(86) PCT No.: PCT/JP2014/006424
§ 371 (c)(1),
(2) Date: Jul. 15, 2016

(87) PCT Pub. No.: WO2015/111120
PCT Pub. Date: Jul. 30, 2015

(65) Prior Publication Data

US 2016/0333899 A1 Nov. 17, 2016

(30) Foreign Application Priority Data

Jan. 21, 2014 (JP) ..... 2014-008616

(51) Int. Cl.
*F15B 11/04* (2006.01)
*F15B 13/042* (2006.01)
(Continued)

(52) U.S. Cl.
CPC ..... *F15B 13/0426* (2013.01); *F15B 11/042* (2013.01); *F15B 11/044* (2013.01);
(Continued)

(58) Field of Classification Search
CPC ..... F15B 11/08; F15B 11/16; F15B 11/028; F15B 11/0406; F15B 20/002; F15B 11/042; F15B 11/044; F15B 13/0426; E02F 9/22
See application file for complete search history.

(56) References Cited

U.S. PATENT DOCUMENTS 6,050,090 A * 4/2000 Tohji ..... E02F 9/2203 60/421
6,981,371 B2 * 1/2006 Imanishi ..... E02F 9/2225 60/420

FOREIGN PATENT DOCUMENTS

JP H11-241702 A 9/1999
JP 2005-140153 A 6/2005
(Continued)

OTHER PUBLICATIONS

Apr. 7, 2015 International Search Report issued in International Patent Application No. PCT/JP2014/006424.
(Continued)

*Primary Examiner* — Michael Leslie
*Assistant Examiner* — Abiy Teka
(74) *Attorney, Agent, or Firm* — Oliff PLC

(57) ABSTRACT

A fluid pressure system includes an actuator, an operating valve, and a spool valve. The spool valve is connected to a pressure source and a tank by a pressure source line and a tank line, respectively, and connected to the actuator by a first movement line and a second movement line. The spool valve moves from a neutral position to a movement position by a moving amount corresponding to a pilot pressure outputted from the operating valve, the movement position being a position at which the spool valve allows the pressure source line to communicate with the first movement line and allows the second movement line to communicate with the tank line. A relief line branches off from the second move-
(Continued)

ment line, and the relief line connects to a tank. A variable throttle valve is provided on the relief line.

8 Claims, 3 Drawing Sheets

(51) Int. Cl.

| | |
|---|---|
| ***F15B 11/042*** | (2006.01) |
| ***F15B 11/044*** | (2006.01) |
| ***F15B 20/00*** | (2006.01) |
| ***F15B 11/08*** | (2006.01) |
| ***F15B 13/04*** | (2006.01) |

(52) U.S. Cl.

CPC ..... *F15B 11/08* (2013.01); *F15B 13/0406* (2013.01); *F15B 20/002* (2013.01); *F15B 2211/205* (2013.01); *F15B 2211/25* (2013.01); *F15B 2211/329* (2013.01); *F15B 2211/40515* (2013.01); *F15B 2211/41572* (2013.01); *F15B 2211/41581* (2013.01); *F15B 2211/426* (2013.01); *F15B 2211/455* (2013.01); *F15B 2211/46* (2013.01); *F15B 2211/6316* (2013.01); *F15B 2211/8623* (2013.01)

(56) References Cited

FOREIGN PATENT DOCUMENTS

| | | | |
|---|---|---|---|
| JP | 2005140153 A | * | 6/2005 |
| JP | 2005-325911 A | | 11/2005 |
| JP | 2013-204223 A | | 10/2013 |

OTHER PUBLICATIONS

Jul. 26, 2016 International Preliminary Report on Patentability issued in International Patent Application No. PCT/JP2014/006424.
Feb. 6, 2017 Office Action issued in Chinese Patent Application No. 201480071918.3.

* cited by examiner

FLUID PRESSURE SYSTEM

TECHNICAL FIELD

The present invention relates to a fluid pressure system for driving an actuator by pneumatic pressure or hydraulic pressure.

BACKGROUND ART

Conventionally, there have been known fluid pressure systems for driving actuators by pneumatic pressure or hydraulic pressure. For example, Patent Literature 1 discloses a fluid pressure system 100 as shown in FIG. 5, in which a bridge circuit is formed between a hydraulic pump 110 and a cylinder 120.

Specifically, in the fluid pressure system 100 shown in FIG. 5, the hydraulic pump 110 and the head side of the cylinder 120 are connected by a first supply line 131, and the hydraulic pump 110 and the rod side of the cylinder 120 are connected by a second supply line 132. The first and second supply lines 131 and 132 are provided with first and second spool valves 141 and 142, respectively. A first tank line 133 branches off from the first supply line 131 at a position between the first spool valve 141 and the cylinder 120. The first tank line 133 is provided with a third spool valve 143. Similarly, a second tank line 134 branches off from the second supply line 132 at a position between the second spool valve 142 and the cylinder 120. The second tank line 134 is provided with a fourth spool valve 144.

The first to fourth spool valves 141 to 144 are solenoid variable throttle valves, and are controlled by a controller 150. The controller 150 transmits electrical signals to the first to fourth spool valves 141 to 144 in accordance with an operating amount of an operating lever 160 operated by an operator.

CITATION LIST

Patent Literature

PTL 1: Japanese Laid-Open Patent Application Publication No. H11-241702

SUMMARY OF INVENTION

Technical Problem

In the fluid pressure system 100 as shown in FIG. 5, all the spool valves 141 to 144 can be controlled independently of one another. For this reason, when the cylinder 120 is expanded and contracted, meter-in control or meter-out control can be performed suitably in accordance with the magnitude of a load pressure and a speed at which the actuator is to be moved. For example, in order to perform meter-out control at the time of expanding the cylinder 120, the opening area of the fourth spool valve 144 may be controlled in a state where the second spool valve 142 and the third spool valve 143 are fully closed and the first spool valve 141 is opened to a certain degree.

However, in the fluid pressure system 100 as shown in FIG. 5, if an electric system fails, then the cylinder 120 cannot be driven even if the operator operates the operating lever 160.

In view of the above, an object of the present invention is to provide a fluid pressure system capable of driving an actuator even when a failure has occurred in an electric system and capable of performing meter-out or meter-in control.

Solution to Problem

In order to solve the above-described problems, one aspect of the present invention is to provide a fluid pressure system including: an actuator; an operating valve that outputs a pilot pressure in accordance with an operating amount from an operator; a spool valve connected to a pressure source and a tank by a pressure source line and a tank line, respectively, and connected to the actuator by a first movement line and a second movement line, the spool valve moving from a neutral position to a movement position by a moving amount corresponding to the pilot pressure outputted from the operating valve, the movement position being a position at which the spool valve allows the pressure source line to communicate with the first movement line and allows the second movement line to communicate with the tank line; a relief line that branches off from the second movement line and connects to a tank; and a variable throttle valve provided on the relief line.

According to the above configuration, even if a failure has occurred in an electric system or the variable throttle valve provided on the relief line, the communication between the first movement line and the pressure source line and the communication between the second movement line and the tank line in accordance with an operation by the operator are secured owing to the pilot-type spool valve. Therefore, the driving of the actuator in response to an operation by the operator can be assured. It should be noted that, in the case of using a single spool valve, the opening area at the supply side (meter-in) and the opening area at the discharge side (meter-out) are controlled at the same time. Therefore, control of changing meter-out characteristics without changing meter-in characteristics cannot be performed by the single spool valve alone. In this respect, the present invention includes the relief line, which is provided with the variable throttle valve. This makes it possible to perform desired meter-out control without changing the meter-in characteristics.

Another aspect of the present invention is to provide a fluid pressure system including: an actuator; an operating valve that outputs a pilot pressure in accordance with an operating amount from an operator; a spool valve connected to a pressure source and a tank by a pressure source line and a tank line, respectively, and connected to the actuator by a first movement line and a second movement line, the spool valve moving from a neutral position to a movement position by a moving amount corresponding to the pilot pressure outputted from the operating valve, the movement position being a position at which the spool valve allows the pressure source line to communicate with the first movement line and allows the second movement line to communicate with the tank line; a parallel line that branches off from the pressure source line and connects to the first movement line; and a variable throttle valve provided on the parallel line.

According to the above configuration, even if a failure has occurred in an electric system or the variable throttle valve provided on the parallel line, the communication between the first movement line and the pressure source line and the communication between the second movement line and the tank line in accordance with an operation by the operator are secured owing to the pilot-type spool valve. Therefore, the driving of the actuator in response to an operation by the operator can be assured. It should be noted that, in the case of using a single spool valve, the opening area at the supply side and the opening area at the discharge side are controlled at the same time. Therefore, control of changing meter-in characteristics without changing meter-out characteristics cannot be performed by the single spool valve alone. In this respect, the present invention includes the parallel line, which is provided with the variable throttle valve. This makes it possible to perform desired meter-in control without changing the meter-out characteristics.

In each of the above-described fluid pressure systems, for example, the variable throttle valve may be a pilot-type valve that increases its opening area in accordance with an increase in a pilot pressure, and the fluid pressure system may further include a solenoid proportional valve that outputs the pilot pressure to the variable throttle valve.

Each of the above-described fluid pressure systems may further include: an operation detector that detects the pilot pressure outputted from the operating valve; and a controller that supplies an electric current whose magnitude corresponds to the pilot pressure detected by the operation detector to the solenoid proportional valve. According to this configuration, when the operator has increased the operating amount to move the actuator fast, the opening area of the variable throttle valve increases automatically. This makes it possible to properly respond to an instruction from the operator.

For example, the spool valve may be a three-position valve that moves between the neutral position and a first movement position, which is the movement position, and moves between the neutral position and a second movement position, at which the spool valve allows the pressure source line to communicate with the second movement line and allows the first movement line to communicate with the tank line.

Advantageous Effects of Invention

The present invention makes it possible to realize a fluid pressure system capable of driving an actuator even when a failure has occurred in an electric system and capable of performing meter-out or meter-in control.

DESCRIPTION OF EMBODIMENTS

Embodiment 1

Figure 1:
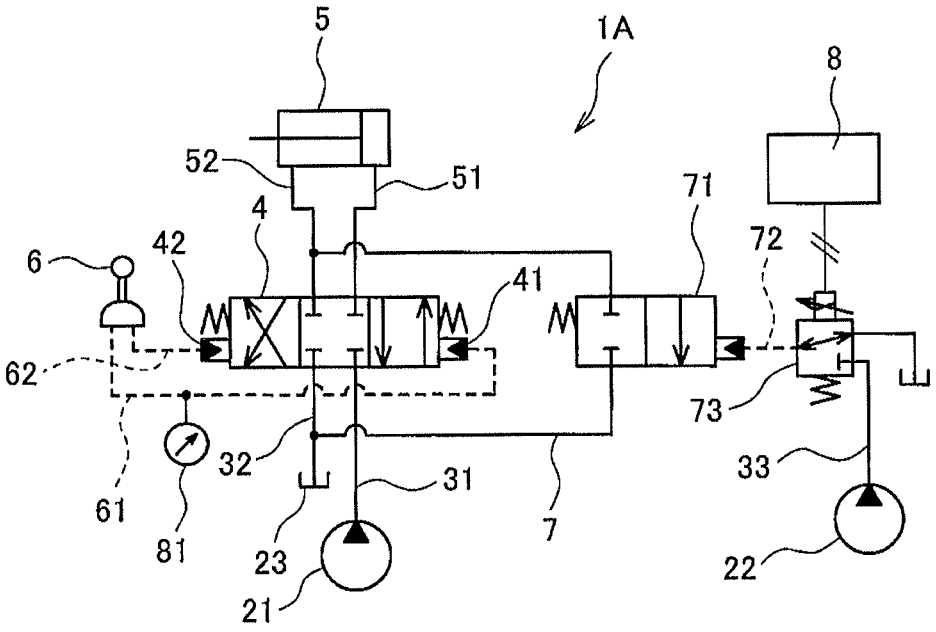
FIG. 1 shows the configuration of a fluid pressure system according to Embodiment 1 of the present invention.

FIG. 1 shows a fluid pressure system 1A according to Embodiment 1 of the present invention. The fluid pressure system 1A according to the present embodiment drives a cylinder 5 by hydraulic pressure, and adopts a hydraulic pump 21 as a pressure source. However, alternatively, the fluid pressure system 1A may drive the cylinder 5 by pneumatic pressure, and adopt a pneumatic pressure source, such as a compressor, instead of the hydraulic pump 21. In the present invention, the actuator is not necessarily the cylinder 5, but may be a different actuator, such as a hydraulic motor.

The fluid pressure system 1A includes a spool valve 4 interposed between the hydraulic pump 21 and the cylinder 5. To be more specific, the spool valve 4 is connected to the hydraulic pump 21 by a pressure source line 31, and is connected to a tank 23 by a tank line 32. Also, the spool valve 4 is connected to the head side of the cylinder 5 by a first movement line 51, and is connected to the rod side of the cylinder 5 by a second movement line 52.

In the present embodiment, the spool valve 4 is a three-position valve that moves between a neutral position and a first movement position (right-side position in FIG. 1), and also moves between the neutral position and a second movement position (left-side position in FIG. 1). When the spool valve 4 moves between the neutral position and the first movement position, or between the neutral position and the second movement position, the amount of opening at the supply side (meter-in) and the amount of opening at the discharge side (meter-out) change continuously. When the spool valve 4 is at the neutral position, the communication among all the lines 31, 32, 51, and 52 is blocked. When the spool valve 4 moves from the neutral position to the first movement position, the pressure source line 31 comes into communication with the first movement line 51, and the second movement line 52 comes into communication with the tank line 32. As a result, the cylinder 5 expands. On the other hand, when the spool valve 4 moves from the neutral position to the second movement position, the pressure source line 31 comes into communication with the second movement line 52, and the first movement line 51 comes into communication with the tank line 32. As a result, the cylinder 5 contracts.

Figure 2:
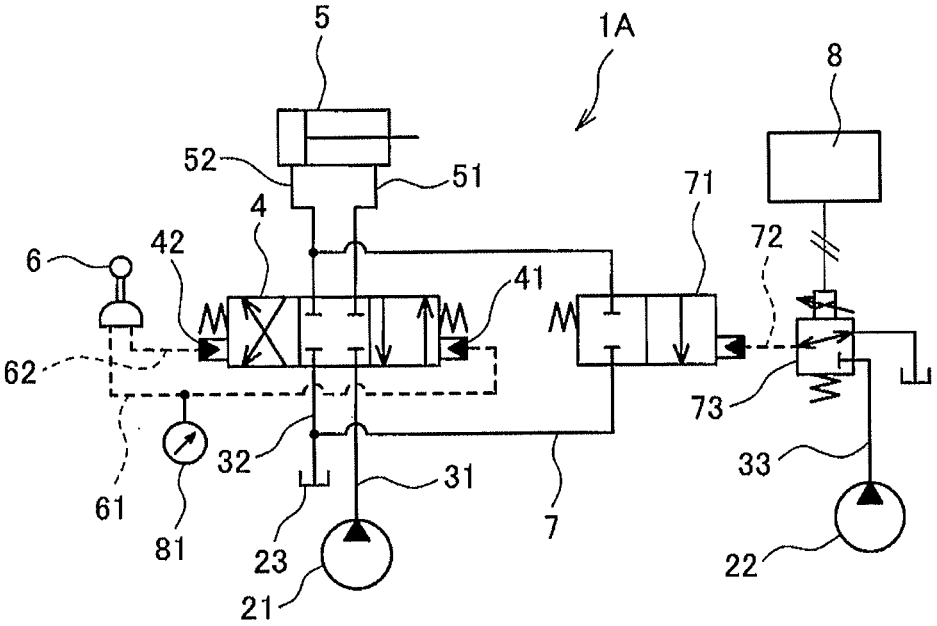
FIG. 2 shows a variation of Embodiment 1.

It should be noted that the cylinder 5 may be driven in a reverse manner to the present embodiment. That is, as shown in FIG. 2, the first movement line 51 may be connected to the rod side of the cylinder 5, and the second movement line 52 may be connected to the head side of the cylinder 5.

The spool valve 4 is a pilot-type valve driven by a pilot pressure outputted from an operating valve 6. Specifically, the spool valve 4 includes: a first pilot port 41 for moving the spool valve 4 from the neutral position to the first movement position; and a second pilot port 42 for moving the spool valve 4 from the neutral position to the second movement position. The operating valve 6 is connected to the first pilot port 41 by a first pilot line 61, and is connected to the second pilot port 42 by a second pilot line 62.

The operating valve 6 includes an input unit (e.g., an operating lever) operated by an operator, and outputs a pilot pressure whose magnitude corresponds to an operating amount of the input unit to the spool valve 4 through the first pilot line 61 or the second pilot line 62. The spool valve 4 moves from the neutral position to the first movement position or the second movement position by a moving amount corresponding to the pilot pressure outputted from the operating valve 6. That is, in a case where the spool valve 4 moves to the first movement position, a first opening area by which the pressure source line 31 communicates with the first movement line 51, and a second opening area by which the second movement line 52 communicates with the tank line 32, are controlled in accordance with an operating amount of the input unit operated by the operator. On the other hand, in a case where the spool valve 4 moves to the second movement position, a third opening area by which the pressure source line 31 communicates with the second movement line 52, and a fourth opening area by which the first movement line 51 communicates with the tank line 32, are controlled in accordance with an operating amount of the input unit operated by the operator.

In addition, the present embodiment adopts a configuration for performing control by which meter-out characteristics can be changed when the cylinder 5 is expanded (i.e., when the spool valve 4 moves to the first movement position). Specifically, the fluid pressure system 1A includes a relief line 7, which branches off from the second movement line 52 and connects to the tank 23. A variable throttle valve 71 is provided on the relief line 7.

In the present embodiment, the variable throttle valve 71 is a pilot-type spool valve. The pilot port of the variable throttle valve 71 is connected to a solenoid proportional valve 73 by a secondary pressure line 72, and the solenoid proportional valve 73 is connected to a hydraulic pump 22 by a primary pressure line 33.

The variable throttle valve 71 is configured to increase its opening area in accordance with an increase in a pilot pressure. The solenoid proportional valve 73 is supplied with an electric current from a controller 8. The solenoid proportional valve 73 outputs the pilot pressure, which is proportional to the supplied electric current, to the variable throttle valve 71.

As described above, in the fluid pressure system 1A according to the present embodiment, even if the solenoid proportional valve 73 has stopped functioning due to a failure in an electric system, or a failure has occurred in the solenoid proportional valve 73 or the variable throttle valve 71, the communication of the first and second movement lines 51 and 52 with the pressure source line 31 and the tank line 32 in accordance with an operation by the operator is secured owing to the pilot-type spool valve 4. Therefore, the driving of the cylinder 5 in response to an operation by the operator can be assured even though the speed of the cylinder 5 is out of the most desired characteristics. It should be noted that, in the case of using the single spool valve 4, the opening area at the supply side and the opening area at the discharge side are controlled at the same time. Therefore, control of changing only the meter-out characteristics cannot be performed by the single spool valve 4 alone. In this respect, the present embodiment includes the relief line 7, which is provided with the variable throttle valve 71. This makes it possible to perform desired meter-out control independently of meter-in characteristics when the cylinder 5 is expanded.

For example, the following meter-out control is conceivable. An operation detector 81, which detects the pilot pressure outputted from the operating valve 6, is provided on the first pilot line 61. The controller 8 supplies an electric current whose magnitude corresponds to the pilot pressure detected by the operation detector 81 to the solenoid proportional valve 73. The meaning of the "electric current whose magnitude corresponds to the pilot pressure" herein includes the electric current being proportional to the pilot pressure and the electric current increasing exponentially in accordance with an increase in the pilot pressure. According to this configuration, when the operator has increased the operating amount to move the cylinder 5 fast, the opening area of the variable throttle valve 71 increases automatically. This makes it possible to properly respond to an instruction from the operator.

Alternatively, at the time of expanding the cylinder 5, the variable throttle valve 71 may be fully opened as a normal state, and the opening area of the variable throttle valve 71 can be decreased in accordance with the load of the cylinder 5.

Variations

The variable throttle valve 71 may be configured to decrease its opening area in accordance with an increase in the pilot pressure. In addition, the variable throttle valve 71 is not necessarily a hydraulic pilot-type valve, but may be integrated with a solenoid driver.

A configuration including a pressure meter that measures the pressure of the movement line 51 may be adopted, in which the opening area of the variable throttle valve 91 increases in accordance with an increase in the pressure. According to this configuration, changes in the speed of the cylinder 5 occurring in accordance with the magnitude of the load can be suppressed. In other words, the cylinder 5 can be driven to move at the same speed regardless of the magnitude of the load.

Embodiment 2

Figure 3:
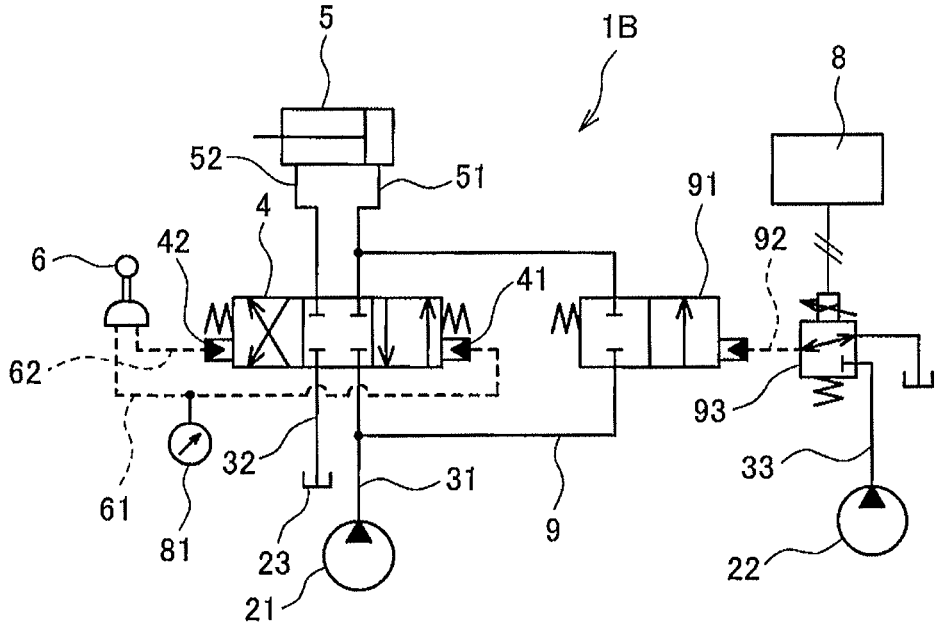
FIG. 3 shows the configuration of a fluid pressure system according to Embodiment 2 of the present invention.

Next, a fluid pressure system 1B according to Embodiment 2 of the present invention is described with reference to FIG. 3. It should be noted that, in the present embodiment, the same components as those described in Embodiment 1 are denoted by the same reference signs as those used in Embodiment 1, and repeating the same descriptions is avoided below.

Figure 4:
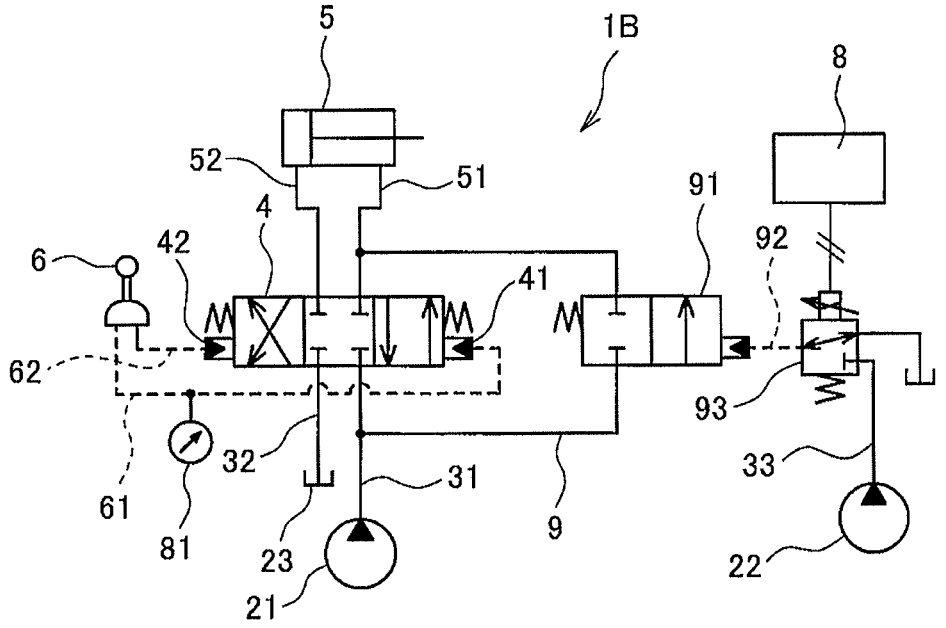
FIG. 4 shows a variation of Embodiment 2.
Figure 5:
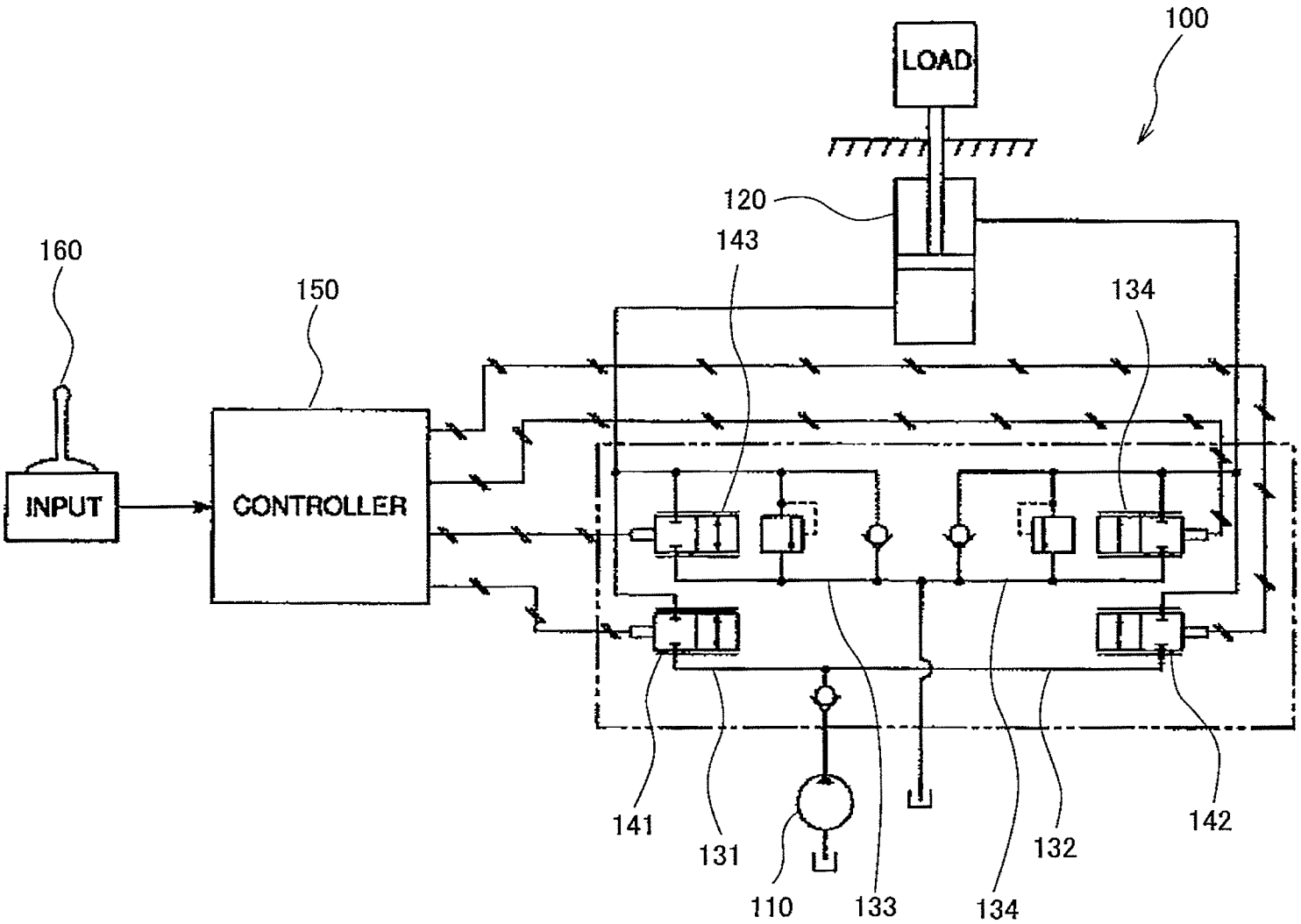
FIG. 5 shows the configuration of a conventional fluid pressure system.

In the present embodiment, similar to Embodiment 1, the first movement line 51 is connected to the head side of the cylinder 5, and the second movement line 52 is connected to the rod side of the cylinder 5. However, as an alternative, the first movement line 51 may be connected to the rod side of the cylinder 5 and the second movement line 52 may be connected to the head side of the cylinder 5 as shown in FIG. 4.

The present embodiment adopts a configuration for performing control by which meter-in characteristics can be changed when the cylinder 5 is expanded (i.e., when the spool valve 4 moves to the first movement position (right-side position in FIG. 3)). Specifically, the fluid pressure system 1B includes a parallel line 9, which branches off from the pressure source line 31 and connects to the first movement line 51. A variable throttle valve 91 is provided on the parallel line 9.

In the present embodiment, the variable throttle valve 91 is a pilot-type spool valve. The pilot port of the variable throttle valve 91 is connected to a solenoid proportional valve 93 by a secondary pressure line 92, and the solenoid proportional valve 93 is connected to the hydraulic pump 22 by the primary pressure line 33.

The variable throttle valve 91 is configured to increase its opening area in accordance with an increase in a pilot pressure. The solenoid proportional valve 93 is supplied with an electric current from the controller 8. The solenoid proportional valve 93 outputs the pilot pressure, which is proportional to the supplied electric current, to the variable throttle valve 91.

As described above, in the fluid pressure system 1B according to the present embodiment, even if the solenoid proportional valve 93 has stopped functioning due to a failure in an electric system, or a failure has occurred in the solenoid proportional valve 93 or the variable throttle valve 91, the communication of the first and second movement lines 51 and 52 with the pressure source line 31 and the tank line 32 in accordance with an operation by the operator is secured owing to the pilot-type spool valve 4. Therefore, the driving of the cylinder 5 in response to an operation by the operator can be assured even though the speed of the cylinder 5 is out of the most desired characteristics. It should be noted that, in the case of using the single spool valve 4, the opening area at the supply side and the opening area at the discharge side are controlled at the same time. Therefore, control of changing only the meter-in characteristics cannot be performed by the single spool valve 4 alone. In this respect, the present embodiment includes the parallel line 9, which is provided with the variable throttle valve 91. This makes it possible to perform desired meter-in control independently of meter-out characteristics when the cylinder 5 is expanded.

For example, the following meter-in control is conceivable. The operation detector 81, which detects the pilot pressure outputted from the operating valve 6, is provided on the first pilot line 61. The controller 8 supplies an electric current whose magnitude corresponds to the pilot pressure detected by the operation detector 81 to the solenoid proportional valve 93. The meaning of the "electric current whose magnitude corresponds to the pilot pressure" herein includes the electric current being proportional to the pilot pressure and the electric current increasing exponentially in accordance with an increase in the pilot pressure. According to this configuration, when the operator has increased the operating amount to move the cylinder 5 fast, the opening area of the variable throttle valve 91 increases automatically. This makes it possible to properly respond to an instruction from the operator.

Alternatively, at the time of expanding the cylinder 5, the variable throttle valve 91 may be fully closed as a normal state, and the opening area of the variable throttle valve 91 can be increased in accordance with the load of the cylinder 5.

Variations

The variable throttle valve 91 may be configured to decrease its opening area in accordance with an increase in the pilot pressure. In addition, the variable throttle valve 91 is not necessarily a hydraulic pilot-type valve, but may be integrated with a solenoid driver.

A configuration including a pressure meter that measures the pressure of the movement line 51 may be adopted, in which the opening area of the variable throttle valve 91 increases in accordance with an increase in the pressure. According to this configuration, reduction in the movement of the cylinder 5 in accordance with the magnitude of the load can be prevented. In other words, the cylinder 5 can be driven to move at the same speed regardless of the magnitude of the load.

Other Embodiments

Embodiment 1 and Embodiment 2 can be combined together. That is, the fluid pressure system may include both the relief line 7 provided with the variable throttle valve 71 and the parallel line 9 provided with the variable throttle valve 91. In this case, the variable throttle valve 71 and the variable throttle valve 91 may form a single three-position spool valve with four ports.

It is not essential that the spool valve of the present invention be a three-position valve. For example, the spool valve 4 in Embodiment 1 or 2 may be divided into: a first spool valve that is a two-position valve moving between the neutral position and the first movement position (right-side position in FIGS. 1 to 4); and a second spool valve that is a two-position valve moving between the neutral position and the second movement position (left-side position in FIGS. 1 to 4). In this case, the first spool valve corresponds to the spool valve of the present invention.

INDUSTRIAL APPLICABILITY

The fluid pressure system according to the present invention is applicable to various fluid pressure circuits.

REFERENCE SIGNS LIST

1A, 1B fluid pressure system
21 hydraulic pump (pressure source)
23 tank
31 pressure source line
32 tank line
4 spool valve
5 cylinder (actuator)
51 first movement line
52 second movement line
7 relief line
71 variable throttle valve
73 solenoid proportional valve
8 controller
9 parallel line
91 variable throttle valve
93 solenoid proportional valve

The invention claimed is:

1. A fluid pressure system comprising:
an actuator;
an operating valve that outputs a pilot pressure in accordance with an operating amount from an operator;
a spool valve connected to a pressure source and a tank by a pressure source line and a tank line, respectively, and connected to the actuator by a first movement line and a second movement line, the spool valve moving from a neutral position to a movement position by a moving amount corresponding to the pilot pressure outputted from the operating valve, the movement position being a position at which the spool valve allows the pressure source line to communicate with the first movement line and allows the second movement line to communicate with the tank line;
a relief line that branches off from the second movement line and connects to the tank;
a variable throttle valve provided on the relief line, wherein the variable throttle valve is a pilot-type valve that increases its opening area in accordance with an increase in a pilot pressure;
a solenoid proportional valve that outputs the pilot pressure to the variable throttle valve;
an operation detector that detects the pilot pressure outputted from the operating valve; and
a controller that supplies an electric current whose magnitude corresponds to the pilot pressure detected by the operation detector to the solenoid proportional valve.

2. The fluid pressure system according to claim 1, wherein the spool valve is a three-position valve that moves between the neutral position and a first movement position, which is the movement position, and moves between the neutral position and a second movement position, at which the spool valve allows the pressure source line to communicate with the second movement line and allows the first movement line to communicate with the tank line.

3. A fluid pressure system comprising:
an actuator;

an operating valve that outputs a pilot pressure in accordance with an operating amount from an operator;

a spool valve connected to a pressure source and a tank by a pressure source line and a tank line, respectively, and connected to the actuator by a first movement line and a second movement line, the spool valve moving from a neutral position to a movement position by a moving amount corresponding to the pilot pressure outputted from the operating valve, the movement position being a position at which the spool valve allows the pressure source line to communicate with the first movement line and allows the second movement line to communicate with the tank line;

a parallel line that branches off from the pressure source line and connects to the first movement line; and a variable throttle valve provided on the parallel line.

4. The fluid pressure system according to claim 3, wherein the variable throttle valve is a pilot-type valve that increases its opening area in accordance with an increase in a pilot pressure, and the fluid pressure system further comprises a solenoid proportional valve that outputs the pilot pressure to the variable throttle valve.

5. The fluid pressure system according to claim 4, further comprising:

an operation detector that detects the pilot pressure outputted from the operating valve; and a controller that supplies an electric current whose magnitude corresponds to the pilot pressure detected by the operation detector to the solenoid proportional valve.

6. The fluid pressure system according to claim 5, wherein the spool valve is a three-position valve that moves between the neutral position and a first movement position, which is the movement position, and moves between the neutral position and a second movement position, at which the spool valve allows the pressure source line to communicate with the second movement line and allows the first movement line to communicate with the tank line.

7. The fluid pressure system according to claim 4, wherein the spool valve is a three-position valve that moves between the neutral position and a first movement position, which is the movement position, and moves between the neutral position and a second movement position, at which the spool valve allows the pressure source line to communicate with the second movement line and allows the first movement line to communicate with the tank line.

8. The fluid pressure system according to claim 3, wherein the spool valve is a three-position valve that moves between the neutral position and a first movement position, which is the movement position, and moves between the neutral position and a second movement position, at which the spool valve allows the pressure source line to communicate with the second movement line and allows the first movement line to communicate with the tank line.

* * * * *